US008662588B1

(12) United States Patent
Delmestri

(10) Patent No.: US 8,662,588 B1
(45) Date of Patent: Mar. 4, 2014

(54) CHAIR BASE WITH SCISSOR LIFT

(76) Inventor: Fabio G. Delmestri, High Point, NC (US)

( * ) Notice: Subject to any disclaimer, the term of this patent is extended or adjusted under 35 U.S.C. 154(b) by 0 days.

(21) Appl. No.: 13/528,999

(22) Filed: Jun. 21, 2012

(51) Int. Cl.
*A47C 1/00* (2006.01)

(52) U.S. Cl.
USPC ..... 297/344.16; 297/344.15

(58) Field of Classification Search
USPC ..... 297/344.12, 344.15, 344.16
See application file for complete search history.

(56) References Cited

U.S. PATENT DOCUMENTS

| | | | | | |
|---|---|---|---|---|---|
| 2,299,136 | A | | 10/1942 | Feldman | 5/11 |
| 2,527,111 | A | | 10/1950 | Widrich | 5/611 |
| 2,958,873 | A | | 11/1960 | Ferneau | 5/86.1 |
| 3,143,332 | A | | 8/1964 | Watlington | 248/404 |
| 3,296,395 | A | | 1/1967 | Fraser | 200/83 R |
| 4,593,951 | A | | 6/1986 | Slaats et al. | 297/347 |
| 4,729,539 | A | * | 3/1988 | Nagata | 248/575 |
| 4,784,434 | A | * | 11/1988 | Iwami | 297/216.1 |
| 5,022,105 | A | | 6/1991 | Catoe | 5/11 |
| 5,193,649 | A | * | 3/1993 | Lee | 187/244 |
| 5,251,864 | A | * | 10/1993 | Itou | 248/588 |
| 5,992,930 | A | | 11/1999 | LaPointe et al. | 297/68 |
| D432,804 | S | | 10/2000 | Mizelle et al. | D6/360 |
| 6,170,914 | B1 | | 1/2001 | Chang | 297/339 |
| 6,382,725 | B1 | | 5/2002 | Carroll | 297/330 |
| 6,550,740 | B1 | * | 4/2003 | Burer | 248/564 |
| 6,565,112 | B2 | * | 5/2003 | Hanson et al. | 280/650 |
| 6,857,493 | B2 | * | 2/2005 | Shupp et al. | 180/168 |
| 7,547,072 | B1 | | 6/2009 | Delmestri | 297/423.21 |
| 7,568,675 | B2 | * | 8/2009 | Catton | 248/588 |
| 7,712,836 | B2 | * | 5/2010 | Deml | 297/344.16 |
| D622,516 | S | | 8/2010 | Delmestri | D6/367 |
| 7,770,974 | B2 | * | 8/2010 | Ott et al. | 297/344.15 |
| 7,988,232 | B2 | * | 8/2011 | Weber et al. | 297/344.15 |
| 2011/0101749 | A1 | | 5/2011 | Shih | 297/284.7 |

OTHER PUBLICATIONS

Pending U.S. Appl. No. 13/426,813, filed Mar. 22, 2012; For: Chair Base With Retractable Foot Platform.
Eight page brochure for Midmark 622 and 623 Barrier-Free® Examination Tables, copyright 2005 Midmark Corporation.

* cited by examiner

*Primary Examiner* — Sarah B McPartlin
(74) *Attorney, Agent, or Firm* — Blake P. Hurt

(57) ABSTRACT

A chair lift including scissors pivotally mounted to a carriage and a lifting device pivotally positioned within the carriage. The lifting device closes the scissors and lifts the chair as desired.

6 Claims, 5 Drawing Sheets

CHAIR BASE WITH SCISSOR LIFT

FIELD OF THE INVENTION

The invention herein pertains to a chair base and particularly pertains to a chair having an extendable scissor lift which extends vertically as needed.

DESCRIPTION OF THE PRIOR ART AND OBJECTIVES OF THE INVENTION

Various types of furniture having lifts of some type are well known in the art. Specifically in the medical industry, it is often desirable for a patient to recline in a single piece of furniture that is comfortable while waiting for medical attention as well as functional during examination or treatment. Many of these devices have retractable leg and foot supports, such as shown in co-pending U.S. application Ser. No. 13/426,813. Others have reclining seat backs, such as shown in U.S. Design Pat. No. 432,804. Still others have lifting mechanisms, such as shown in U.S. Pat. No. 6,382,725.

However, these previous devices are often uncomfortable to sit in for any period of time. They also tend to be mechanically complicated and expensive to manufacture and assemble. Further, they are often unwieldy to operate and control, especially for a single doctor or nurse who is more focused on providing medical care than operating a chair.

Thus, in view of the problems and disadvantages associated with prior art devices, the present invention was conceived and one of its objectives is to provide a single piece of furniture that can comfortably support a user for an extended period of time.

It is another objective of the present invention to provide a chair that can fully recline so as to serve as an examination table.

It is still another objective of the present invention to provide a chair lift that can raise a chair by closing scissors mounted thereunder.

It is yet another objective of the present invention to provide a foot operated lift to raise or lower the seat level of a chair.

It is a further objective of the present invention to provide a comfortable chair with a reclining back and extendable foot platform.

It is still a further objective of the present invention to provide a mobile furniture solution in medical settings where positioning patients more than once may be hazardous to their health.

It is yet a further objective of the present invention to provide a foot operated scissor lift contained within a wheeled carriage.

It is yet still a further objective of the present invention to provide a moveable chair which easily converts from a chair to an examination table.

Various other objectives and advantages of the present invention will become apparent to those skilled in the art as a more detailed description is set forth below.

SUMMARY OF THE INVENTION

The aforesaid and other objectives are realized by providing a chair lift that includes scissors that are pivotally mounted to a carriage and a lifting device that is pivotally disposed within the carriage and can lift a chair seat by closing the scissors. The chair lift has universal appeal in that any of a variety of molded or otherwise manufactured chair seats, backs and frames can be attached thereto for quickly and conveniently forming a chair with a lift. The chair lift extends from the carriage through the use of a foot pedal positioned along one side. By depressing one side of the foot pedal, a rod rotates counterclockwise and drives a piston from within a cylinder to raise the chair seat and close the scissors. By depressing the other side of the foot pedal, the rod rotates clockwise which allows the piston to recede into the cylinder causing the scissors to open and the chair seat to descend.

The lifting device is pivotally disposed between a movable carriage and is attached to the frame of the chair. Two tracks with wheels positioned anterior therein are also included. The upper track is attached to the frame of the chair while the lower track is attached to the carriage.

DETAILED DESCRIPTION OF THE PREFERRED EMBODIMENT AND OPERATION OF THE INVENTION

Figure 2:
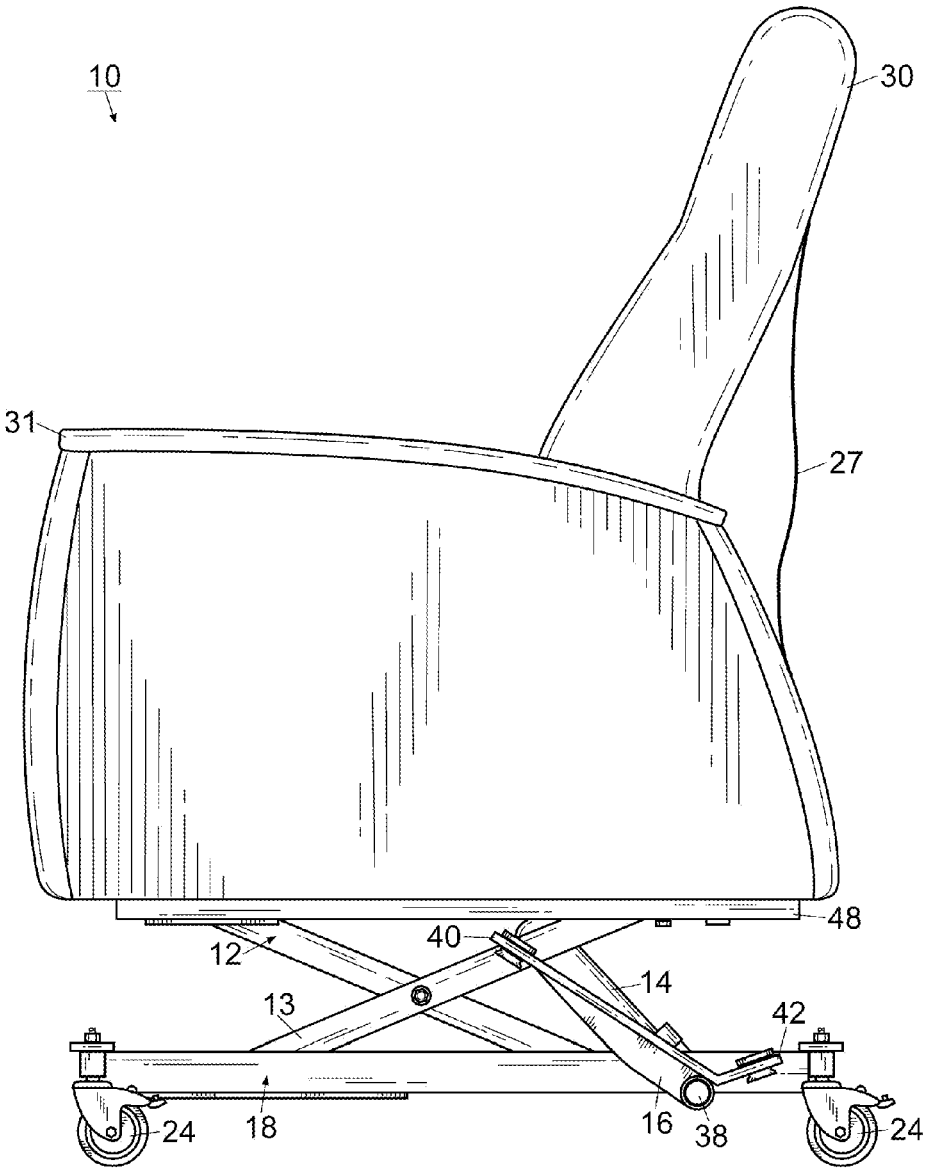
FIG. 2 illustrates a left side elevational view of the chair as seen in FIG. 1 in an upright seating position and slightly elevated to show the scissor lift including pedals with the scissors slightly closed.
Figure 3:
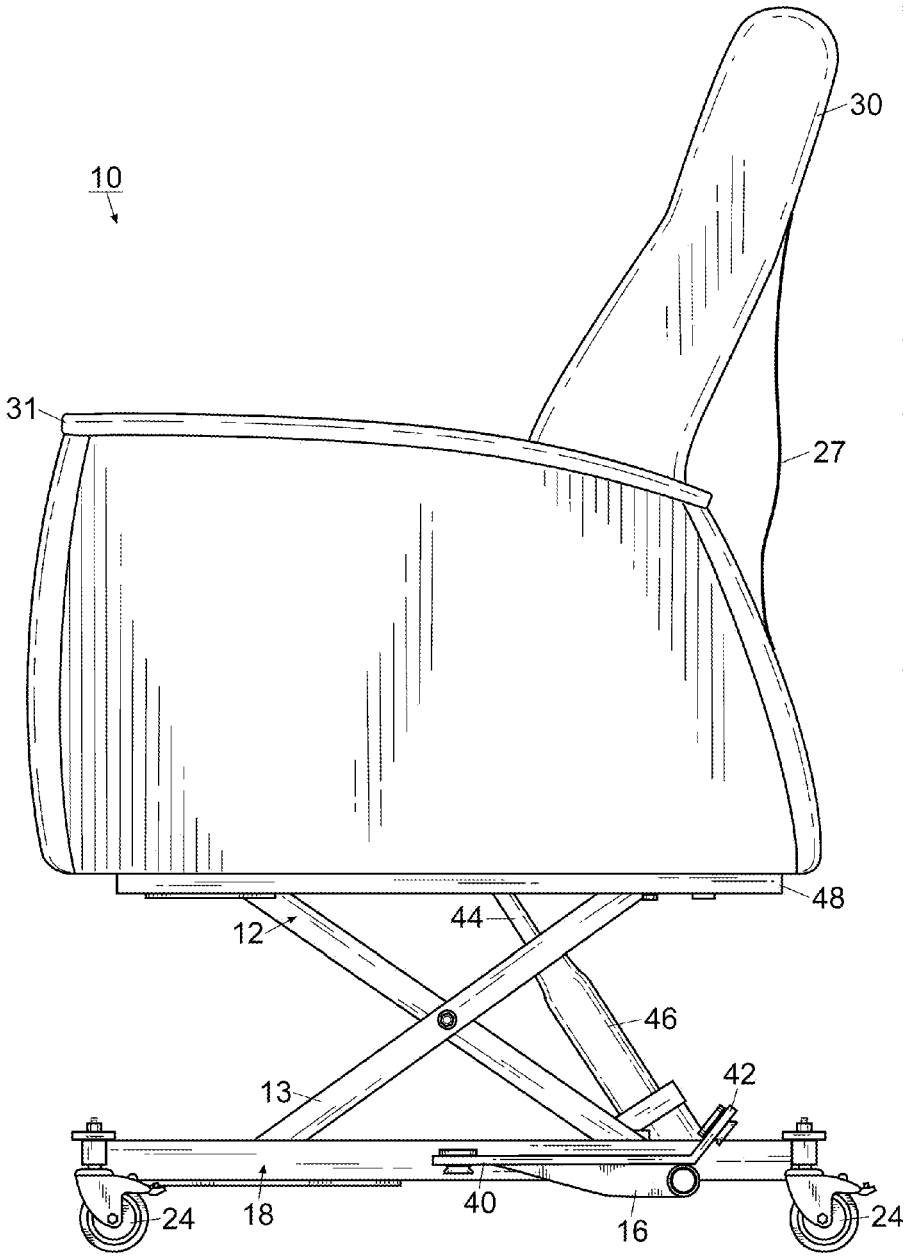
FIG. 3 presents a left side elevational view of the chair as seen in FIG. 2 fully raised having a pedal-operated scissor lift with the longer pedal shown depressed for lifting purposes and the scissors partially closed.
Figure 4:
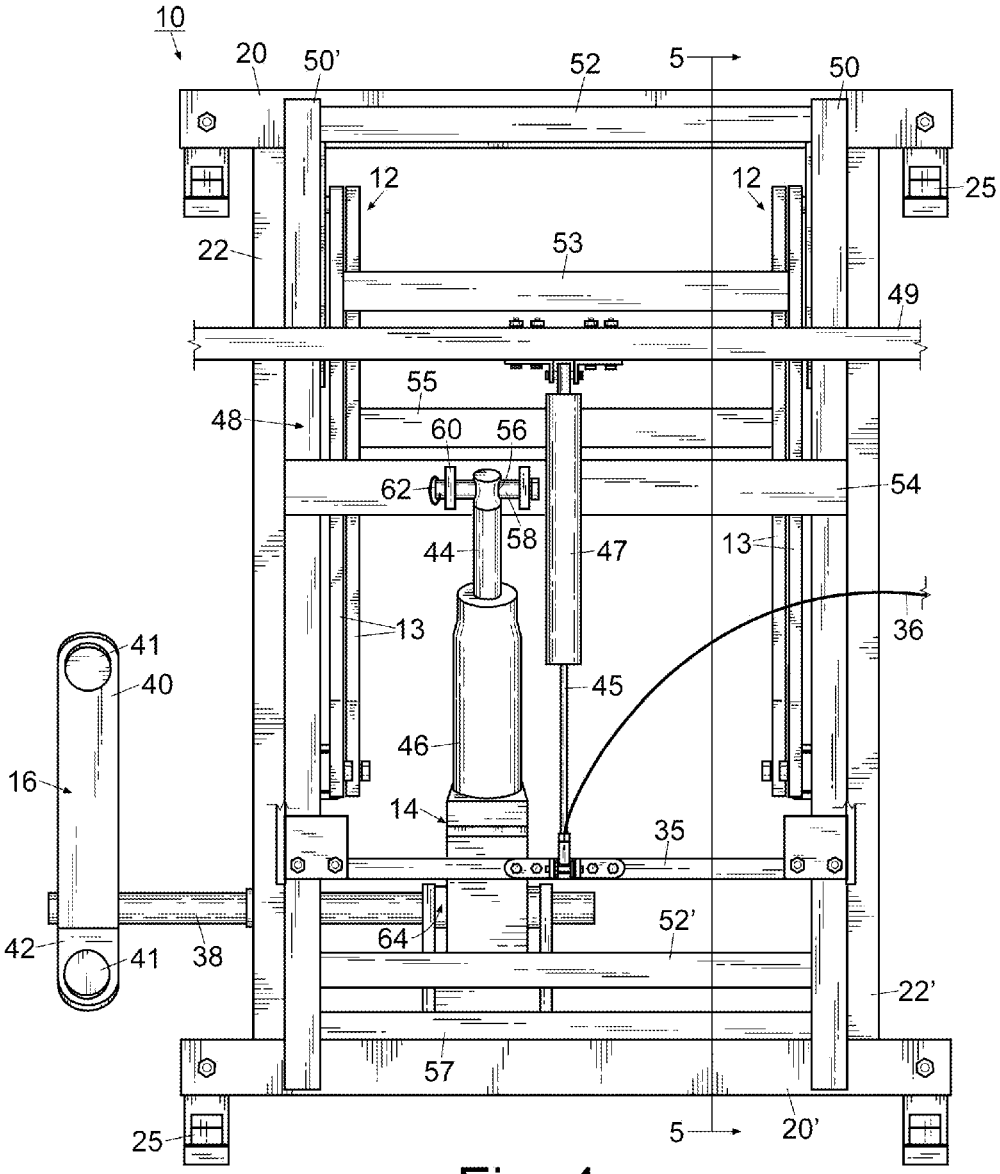
FIG. 4 demonstrates a top plan view of a partially raised chair lift without a seat.

For a better understanding of the invention and its operation, turning now to the drawings, preferred metal chair lift 10 is shown in FIGS. 1-5 having scissors 12 and lifting device 14 which is affixed to chair frame 48 and operated by foot pedal 16. Preferred chair lift 10 is formed from rigid steel to provide for support of different weights and stability during repeated use though aluminum or other materials as suitable may also be used. Chair lift 10 can be used with any of a variety of furniture seats and backs (not shown) integrally formed or molded depending on the desired look and use required. Preferred chair lift 10 includes rectangular carriage 18 that supports and carries lifting device 14. Carriage 18 is preferably comprised of flat, planar members 20, 20' that form the shorter lengths of the rectangle, and tubular members 22, 22' that make up the longer sides as shown in FIG. 4. Carriage 18 also preferably includes wheels 24 (FIG. 1) which are attached to the corners of carriage 18 by conventional means such as bolts (not shown) and allow chair lift 10 and the associated furniture it supports to move easily from one location to another, even with a person sitting thereon. Preferable wheels 24 further include conventional wheel locks 25 which allow medical or other personnel to securely position chair lift 10 with a patient therein without fear of unintentional rotation of wheels 24. Planar members 20, 20' rigidly attach to the top surface of tubular members 22, 22' (FIG. 4) and may be affixed by welding the respective members together or any other method known in the art to secure metallic members together.

For demonstration purposes, chair lift 10 includes seat cushion 26, foot cushion 28, and back cushion 30 shown in positions as would be understood a typical chair, using chair lift 10 would include, along with side arms 31 and the like.

Figure 1:
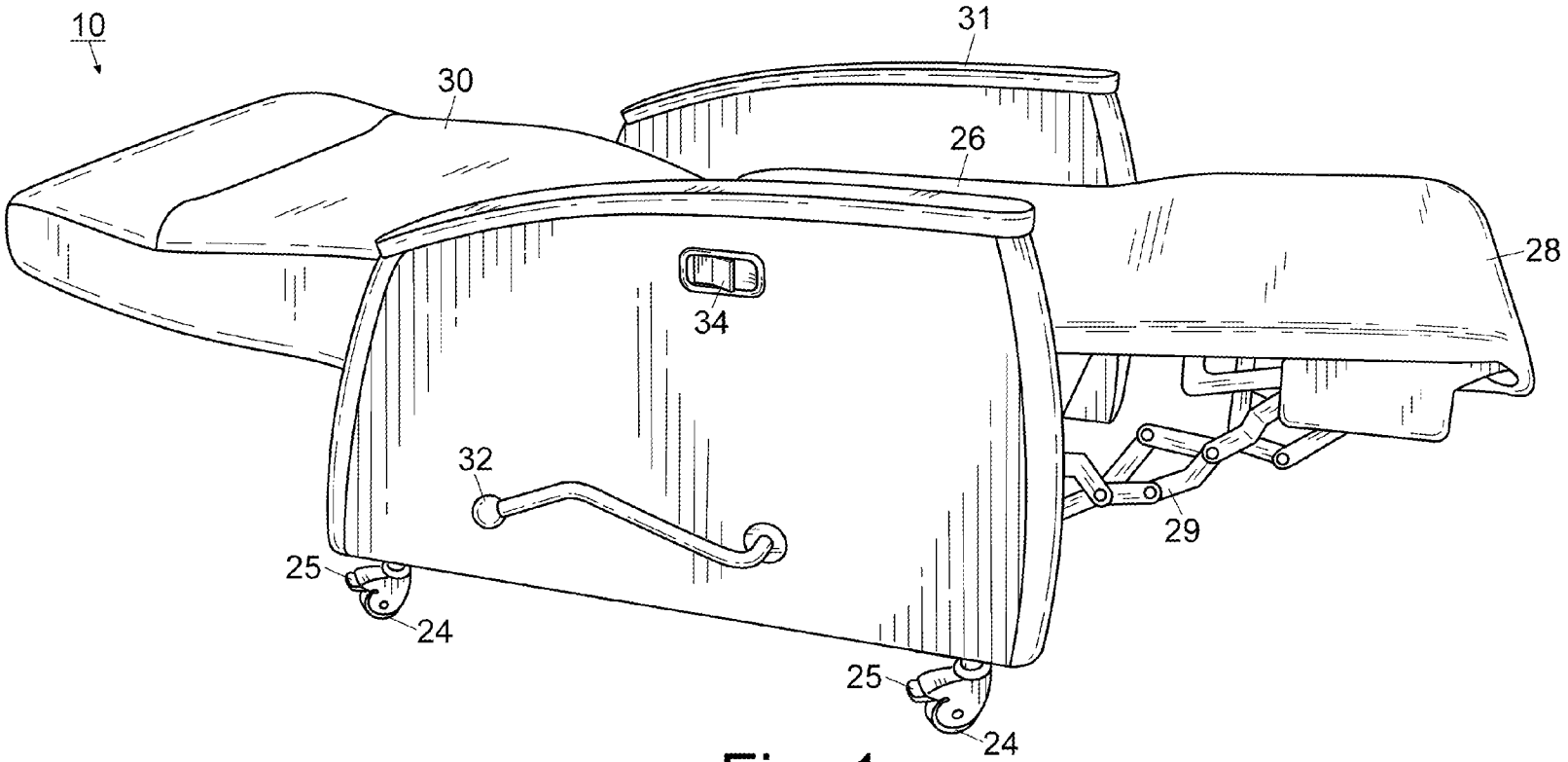
FIG. 1 shows a right perspective view of a chair equipped with a scissor lift, retractable foot platform and reclining back.

A right side perspective view of chair lift 10 is shown in FIG. 1 with back cushion 30 reclined and foot cushion 28 fully extended by linkages 29 for transformation from a chair to an examination table. In the pictured configuration, lifting device 14 is not engaged and scissors 12 are in their most "open" position, in that scissor blades 13 are in their most horizontal orientation. Foot rest handle 32 is also illustrated in FIG. 1 and is shown in its most rearward (counterclockwise rotation) position indicating that foot cushion 28 is fully extended by linkages 29. Only one linkage 29 is shown in FIG. 1 but it is understood that a second linkage 29 is attached to the opposite side of chair frame 48 and in all respects is a mirror image of linkage 29 as shown. By manually rotating foot rest handle 32 forwardly (clockwise rotation), foot cushion 28 retracts until handle 32 reaches its most forward position and foot cushion 28 is fully retracted and linkages 29 are folded within chair frame 48. The mechanism (not shown) for extending foot cushion 28 and linkage 29 is rotatably attached to chair frame 48 and is known in the art and for brevity will not be described in greater detail herein.

FIG. 1 further illustrates back release switch 34 that may be manually manipulated to recline back cushion 30 which is rotatably attached to chair frame 48 which in turn is pivotally connected to cylinder 47 and back support bar 35 in a conventional manner, for example with brackets and bolts. Connected to cable 36 and small hydraulic cylinder 47 (shown in FIG. 4) in an extended position, back release switch 34 maintains back cushion 30 in a partially vertical orientation when in the "closed" position. However, when back release switch 34 is in the "open" position as shown in FIG. 1, cable 36 relaxes, small hydraulic cylinder 47 retracts, and back cushion 30 pivotally assumes a more horizontal orientation such as shown in FIG. 1. Although cylinder 47 is preferably a hydraulic cylinder, it may also be a pneumatic or electric device as well. The exact positioning of the back cushion 30 in relation to seat cushion 26 can be controlled by manually manipulating back release switch 34 such that different angles of orientation may be achieved by rotating the position of back support bar 35 (FIG. 4). The functioning of back release switch 34, cable 36, and small hydraulic cylinder 47 is known in the art, for example in U.S. Pat. No. 5,992,930 and for brevity will not be described in greater detail herein.

FIG. 2 shows a left side view of a chair including chair lift 10 operated by foot pedal 16 with scissors 12 slightly closed. Foot pedal 16 as shown in FIG. 4 is attached to rotatable rod 38 and when pedal 16 is depressed, rod 38 rotates coincidentally. In the preferred embodiment of chair lift 10, pedal 16 is marked with colored pads 41 on the opposing ends of pedal 16, for example green on one end for lifting and red on the other end for lowering chair lift 10. Pedal 16 is preferably made out of metal and generally forms an L-shape with the angle of pedal 16 forming an intersection of approximately one hundred degrees (130°) with long side 40 of the "L" being anterior in relation to chair lift 10 while short side 42 of the "L" is posterior. Depressing long side 40 of foot pedal 16 from the position as shown in FIG. 2 to the position as shown in FIG. 3, for example with a user's foot (not shown), causes counterclockwise rotation of rod 38 which in turn drives piston 44 out of cylinder 46 that together make up lifting device 14 (FIG. 4). Each time long side 40 is depressed chair lift 10 is incrementally raised to provide for varying height positioning as required. Piston 44 is attached to chair frame 48 and is responsible for the lifting action of chair lift 10. Depressing short side 42, on the other hand, causes clockwise rotation of rod 38 which retracts piston 44 into cylinder 46 and causes chair lift 10 to descend until such time as the user (not shown) releases short side 42 or when chair lift 10 is fully lowered.

FIG. 2 further displays scissors 12 in a slightly closed position. Scissors 12 are made up of blades 13 that preferably operate as a pair joined in the middle, for example with a conventional screw and nut. Although only one pair of blades 13 are presented in FIGS. 2, 3, and 5, it is understood that a corresponding pair of blades 13 as seen in FIG. 4 are attached to the opposite side of chair lift 10 and in all respects are a mirror image thereof. Preferably, the furniture piece that sits atop chair lift 10 also includes zippered back 27 that provides access to the components of chair lift 10 that are otherwise concealed in the event cleaning or repair is necessary.

A left side view of chair lift 10 having foot pedal 16 depressed and scissors 12 partially closed is presented in FIG. 3. As shown in FIG. 2, pedal 16 is attached to rotatable rod 38 with long side 40 forming approximately a one hundred thirty degree (130°) angle with short side 42. When long side 40 is rotatably manually depressed, rod 38 coincidentally rotates clockwise and engages lifting device 14. Lifting device 14 is preferably a hydraulic lift known in the art such as shown in U.S. Pat. Nos. 3,296,395, 3,143,332, and 4,593,951. However, lifting device 14 may also be a pneumatic lift, an electronic lift, or any other lifting device known in the art to be appropriate for raising or lowering furniture. Rod 38 also may engage biasing member 64 (FIG. 4) that prevents over-rotation of rod 38 when raising chair frame 48. In a preferred embodiment, biasing member 64 is a spring that causes pedal 16 to rotate back to a neutral position as oriented prior to being depressed. However, as pedal 16 is depressed repeatedly and chair lift 10 rises, biasing member 64 causes the orientation of pedal 16 to become increasingly more vertical due to increased biasing force. Biasing member 64 also operates in a similar manner when short side 42 is depressed to lower chair frame 48, leading to a more horizontal orientation of pedal 16.

FIG. 4. demonstrates a top plan view of chair lift 10 with lifting device 14 and pedal 16 with scissors 12 slightly closed. Lifting device 14 is pivotally attached to carriage 18 such that when foot pedal 16 is depressed and rod 38 rotates to engage piston 44, cylinder 46 can pivot in an arch to accommodate piston 44 which is affixed to chair frame 48 when ascending or descending. In one embodiment, chair frame 48 comprises a pair of tubular longitudinal members 50, 50' and a pair of tubular lateral members 52, 52', one lateral member 52 interacting with longitudinal members 50, 50' at the terminal ends of longitudinal members 50, 50' towards the anterior or front of chair frame 48 and the other lateral member 52' interacting with longitudinal members 50, 50' prior to the terminal ends of longitudinal members 50, 50' towards the posterior or rear of chair frame 48. Longitudinal members 50, 50' and lateral members 52, 52' can be attached by any method such as gluing or bracketing but the preferred method is to rigidly weld members 50, 50', 52, 52' together. Chair frame 48 also includes main transverse member 54 that is rigidly affixed to longitudinal members 50, 50' and serves as the attachment point for piston 44. In the preferred embodiment, piston 44 defines aperture 56 that is configured to receive pin 58. Mounting bracket 60 is attached to transverse member 54 and defines a pair of corresponding apertures (not shown) that are also configured to receive pin 58 such that pin 58 passes through both piston 44 and mounting bracket 60 to pivotally secure piston 44 to chair frame 48. To prevent pin 58 from being dislodged from either mounting bracket 60 or piston aperture 56, pin 58 may be secured by cotter pin 62 which passes through an aperture (not shown) in the end of pin 58.

After pedal 16 is depressed and rod 38 engages lifting device 14 to drive piston 44 from within cylinder 46, piston 44 pivotally raises chair frame 48. This lifting action as illustrated in FIGS. 2 and 3 is accompanied by the gradual closure of scissor blades 13 from their comparatively open posture shown in FIG. 2. FIG. 4 also displays cable 36 that is attached to back release switch 34 which allows a user to recline back cushion 30 as shown in FIG. 1. The user (not shown) pulls back release switch 34 which retracts cable 36 that is also connected to the base of small piston 45 which is affixed to back support bar 35 whereas small hydraulic cylinder 47 is affixed to lateral frame brace 49 such as by conventional brackets, bolts and nuts (not shown). Small piston 45 engages small hydraulic cylinder 47 that biases back cushion 30 by rotating back support bar 35 which is in turn pivotally connected to chair frame 48. Unless otherwise affixed by conventional fasteners, the preferred method of attachment for components of carriage 18 and chair frame 48 is welding, although other boding methods known in the art may also be used to a provide a durable, rigid attachment.

FIG. 4 further presents lower lateral brace 53, upper lateral brace 55, and rear lateral brace 57. Braces 53, 55, and 57, respectively provide rigid structural support both to chair lift 10 and the furniture above. This structural support is necessary, for example in the medical environment where chair lift 10 may be required to lift patients weighing several hundred pounds or support additional medical equipment while enduring repeated use. Lower lateral brace 53 is affixed at opposing ends to upper blades 13 of corresponding pair of scissors 12 anterior chair lift 10 while upper lateral brace 55 is affixed at opposing ends to lower blades 13 in scissors 12 posterior lower lateral brace 53 but anterior chair lift 10 generally. Braces 53 and 55 prevent scissors 12 from flexing or bending under heavy burdens. Rear lateral brace 57 is attached at opposing ends to tubular members 22 and 22' respectively and rigidly reinforces the structural stability of carriage 18.

Figure 5:
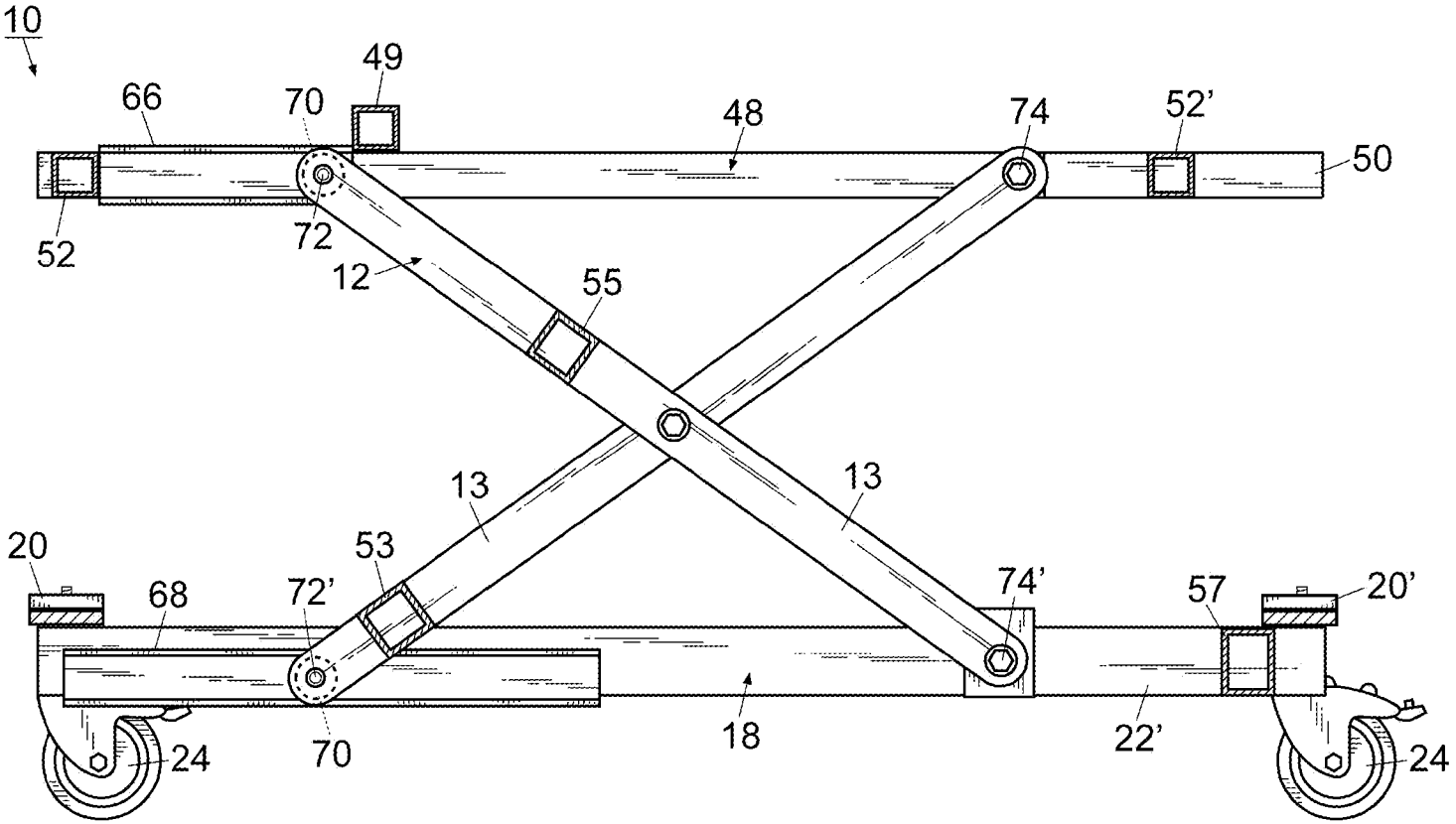
FIG. 5 shows a carriage, an upper track, a lower track and track wheels attached to the scissor lift as seen along lines 5-5 in FIG. 2.

FIG. 5 provides a view of carriage 18, upper track 66, lower track 68, and track wheels 70 that are attached to scissors 12 as seen along lines 5-5 in FIG. 4. Although one upper track 66 and one lower track 68 are shown in FIG. 5, it is to be understood that mirror image tracks are positioned on the opposite side of chair frame 48 and all descriptions also apply to those tracks, respectively. Specifically, blades 13 are attached respectively to different ones of track wheels 70 via front axles 72, 72' (respectively top and bottom) while simultaneously being pivotally affixed to respectively carriage 18 and chair frame 48 via rear axles 74', 74. Track wheels 70 are held within C-shaped upper and lower tracks 66, 68. Upper track 66 is positioned anterior chair frame 48 and lower track 68 is positioned anterior carriage 18, that is to say towards the front of chair frame 48 and carriage 18. Upper track 66 and lower track 68 are preferably welded to respectively chair frame 48 and carriage 18, although other means of attachment are also contemplated. As foot pedal 16 is depressed and piston 44 lifts chair frame 48, blades 13 begin to close which in turn causes track wheels 70 within both upper track 66 and lower track 68 to move rearwardly. Specifically, track wheels 70 within upper track 66 and lower track 68 roll towards the rear of chair frame 48. Alternatively, when track wheels 70 within upper track 66 and lower track 68 roll towards the front of chair lift 10, blades 13 open and chair frame 48 descends.

A method for using chair lift 10 includes the steps of providing a chair having seat cushion 26, extendable foot cushion 28 and reclinable back cushion 30 with carriage 18, wheels 24, scissors 12, lifting device 14, foot pedal 16, chair frame 48, upper track 66 and lower track 68. The method further includes repeatedly depressing long side 40 of pedal 16 to extend piston 44 from within cylinder 46 and raise chair frame 48. The method further includes depressing short side 42 of pedal 16 to retract piston 44 into cylinder 46 and lower chair frame 48.

The illustrations and examples provided herein are for explanatory purposes and are not intended to limit the scope of the appended claims.

I claim:

1. A chair lift for a chair comprising: a frame, a carriage, said carriage defining a rectangle with long and short sides, a lockable caster, said lockable caster attached to said carriage, scissors, said scissors comprising a pair of blades, said pair of blades pivotally joined one to the other at the middle, one end of one of said pair of blades pivotally joined to said carriage and the other end rollingly attached to said frame, one end of the other of said pair of blades pivotally joined to said frame and the other end rollingly attached to said carriage, a pair of C-shaped tracks, one of said pair of C-shaped tracks attached to said carriage and the other of said C-shaped tracks attached to said frame, a pair of track wheels, each of said pair of track wheels attached to different ones of said pair of blades and positioned in different ones of said pair of C-shaped tracks, a lifting device, said lifting device comprising a piston, a cylinder, said piston contained by said cylinder, one end of said piston connected to said frame, said cylinder connected to said carriage, said lifting device pivotally carried by said carriage, a foot pedal, said foot pedal positioned along one long side of said carriage, a rod, said rod rotatably mounted to said carriage, said foot pedal mounted on said rod, a biasing device, said biasing device mounted on said rod proximate said piston, whereby pressing said foot pedal causes said piston rod to extend from said cylinder to close said scissors and raise said frame and allows said biasing device to return said pedal to a neutral position after said pedal is pressed.

2. The chair lift of claim 1 further comprising a pair of lateral scissor braces, each of said pair of scissor braces attached to different ones of said scissor blades.

3. The chair lift of claim 1 wherein said foot pedal is L-shaped, a pair of pads, said pair of pads each opposingly attached along said L-shaped foot pedal.

4. The chair lift of claim 3 wherein said pads are each a different color.

5. The chair lift of claim 1 wherein said carriage further comprises two planar members, two tubular members, said planar members connected to said tubular members to form said rectangular carriage.

6. The chair lift of claim 5 wherein said two planar members are each shorter in length than either of said tubular members.

* * * * *